US005556740A

United States Patent [19]

Suzuki et al.

[11] Patent Number: 5,556,740

[45] Date of Patent: Sep. 17, 1996

[54] HEAT-DEVELOPABLE PHOTOSENSITIVE MATERIAL

[75] Inventors: Takatugu Suzuki; Atsushi Tomotake; Hidenobu Ohya; Nobuyuki Takiyama, all of Tokyo, Japan

[73] Assignee: Konica Corporation, Japan

[21] Appl. No.: 560,889

[22] Filed: Nov. 20, 1995

[30] Foreign Application Priority Data

Nov. 24, 1994 [JP] Japan ..... 6-289934

[51] Int. Cl.[6] ..... G03C 8/12; G03C 8/40

[52] U.S. Cl. ..... 430/559; 430/203; 430/222

[58] Field of Search ..... 430/203, 222, 430/559

[56] References Cited

U.S. PATENT DOCUMENTS

| | | | |
|---|---|---|---|
| 3,719,489 | 3/1973 | Cieciuch et al. | 430/222 |
| 4,098,783 | 7/1978 | Cieciuch et al. | 430/222 |
| 5,316,887 | 5/1994 | Arnost et al. | 430/222 |
| 5,340,689 | 8/1994 | Chinoporos et al. | 430/222 |
| 5,415,970 | 5/1995 | Arnost et al. | 430/222 |

*Primary Examiner*—Richard L. Schilling

*Attorney, Agent, or Firm*—Jordan B. Bierman; Bierman and Muserlian

[57] ABSTRACT

A heat-developable photosensitive material for use in diffusion transfer process is disclosed, comprising a support having in one or more layers a hydrophilic binder, photosensitive silver halide and dye-providing compound represented by the following formula, $$[A\text{-}(J_1)_a\text{-}(X)_b]_c\text{-}J_2\text{-Dye}$$

which is capable of releasing $[\text{-}(J_1)_a\text{-}(X)_b]_c\text{-}J_2$-Dye residue upon cleavage in the presence of a silver ion or a soluble silver complex.

7 Claims, No Drawings

HEAT-DEVELOPABLE PHOTOSENSITIVE MATERIAL

FIELD OF THE INVENTION

The present invention relates to a heat-developable photosensitive material, and particularly relates to a heat-developable photosensitive material for use in diffusion transfer process, which is improved in a transfer density of a magenta dye image.

BACKGROUND OF THE INVENTION

There is well-known heat-development in which developing is carried out by applying heating to obtain a black and white, or color image. A heat-developable photosensitive material for use in diffusion transfer process is also known, in which an image formed through heat-development is transferred to a iamge-receiving layer from a photosensitive material.

A heat-developable photosensitive material conventionally comprises a support having thereon a binder, photosensitive silver halide emulsion, reducing agent, and optionally a dye-providing material, organic silver salt or various photographic additives. The diffusion transfer heat-developable photosensitive material includes one in which the photosensitive material has a layer capable of receiving silver or dye and another one in which, apart from the photosensitive material, an image-receiving material having a layer capable of receiving silver or dye is used therewith.

Among these heat-developable photosensitive materials, there is used a dye providing material capable of forming or releasing a dye upon heat-development to obtain a color image. In such a color heat-developable photosensitive material, from the viewpoint of image sharpness and storage stability of color image, there is preferably employed a system in which a diffusible dye is formed or released and the dye is duffusion-transferred to an image-receiving material.

Such dye-providing materials used in the diffusion transfer type heat-development photosensitive material have been known in the art, most of which are those for use in wet diffusion transfer process (so-called instant photography). These dye-providing materials are classified into two types; one type is one capable of releasing a diffusible dye corresponding to development of silver halide and another type is one capable of releasing a diffusible dye corresponding reversedly to the development of silver halide.

One of the latter type is a dye-providing material capable of releasing a dye upon reaction with a silver ion as a component of silver halide or organic silver salt which is remained undeveloped, or a water-soluble silver ion complex thereof.

Embodiments in which this type of the dye-providing material is applied to wet diffusion transfer process are disclosed in U.S. Pat. Nos. 4,362,806, 3,719,489 and 4,375,507. An embodiment in which the dye-providing material is applied to diffusion transfer type heat-development is disclosed in JP-A 59-180548(1984).

One disadvantage of these dye-providing materails is that it is necessary to develop at a high temperature taking a long time to obtain a sufficiently high density. In other words, it is impossible to obtain a sufficiently high density at a lower temperature over a shorter period of time.

Another disadvantage is that, when the heat-developable photosensitive material containing the dye-providing material is aged, the dye-providing material reacts with a silver ion during storage to release a diffusible dye. Thus, the heat-developable photosensitive material is susceptible to be fogged on storage.

SUMMARY OF THE INVENTION

Accordingly, an object of the present invention is to provide a heat-developable photosensitive material containing a magenta dye-providing material which is capable of providing a low fog density and sufficiently high maximum density obtained by heating at a lower temperature over a shorter period of time. Another object of the invention is that, in the said heat-developable photosensitive material containing the said dye-providing material capable of releasing upon reaction with a silver ion or silver ion complex, it is to prevent the reaction of the dye-providing material with the silver ion or silver complex during the storage to restrict the formation of fog.

The above objects of the invention can be achieved by a heat-developable photosensitive material for use in diffusion transfer process, comprising a support having in one or more layers a hydrophilic binder, photosensitive silver halide and dye-providing material, wherein said dye-providing compound is represented by the following formula (I).

$$[A\text{-}(J_1)_a\text{-}(X)_b]_c\text{-}J_2\text{-Dye} \qquad \text{Formula (I)}$$

In the formula, A represents a 1,3-sulfur-nitrogen-containing compound residue capable of releasing $[\text{-}(J_1)_a\text{-}(X)_b]_c\text{-}J_2$-Dye residue upon cleavage reaction at a high temperature in the presence of a silver ion or silver ion complex; $J_1$ represents a divalent linkage and $J_2$ represents a divalent or trivalent linkage; X represents a divalent linkage selected from the group consisting of —CO—, —COO—, —CONH—, —$SO_2$—, —$SO_2$NH—, —$SO_3$—, —NHCO—, —NH$SO_2$— and —O—; a and b independently represent 0 or 1; c represents 1 or 2; Dye represents a group represented by the following formula (II), (III) or (IV).

Formula (II)

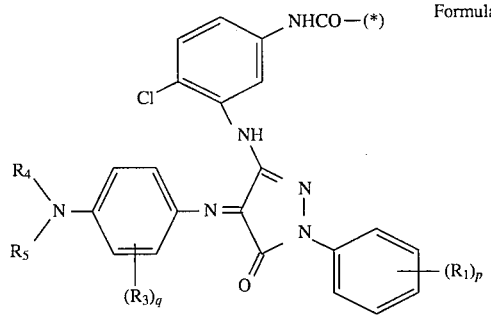

In the formula, $R_1$ represents a halogen atom, alkyl group, alkoxy group, aryloxy group, acylamino group, sulfonylamino group, carbamoyl group or sulfamoyl group; $R_3$ represents an alkyl group, acylamino group or alkoxy group; $R_4$ and $R_5$ independently represent an alkyl group, cycloalkyl group or aryl group, and $R_4$ and $R_5$ may be combined with each other to form a ring; p is an integer of 0 to 5; q is an integer of 0 to 4. In the above formula, the Dye is bonded, at the position (*), with $[A\text{-}(J_1)_a\text{-}(X)_b]_c\text{-}J_2$- residue.

Formula (III)

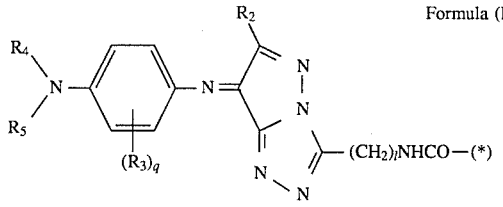

In the formula, $R_2$ represents an alkyl group, cycloalkyl group, aryl group, heterocyclic group, alkoxy group, aryloxy group, acylamino group, sulfonylamino group or anilino group; $R_3$, $R_4$ and $R_5$ each are the same as $R_3$, $R_4$ and $R_5$ as defined in the afore-mentioned formula (II); q represents an integer of 0 to 4; l represents an integer of 1 to 3; the Dye of the above formula is bonded, at the position (*), with $[A\text{-}(J_1)_a\text{-}(X)_b]_c\text{-}J_2$-residue.

Formula (IV)

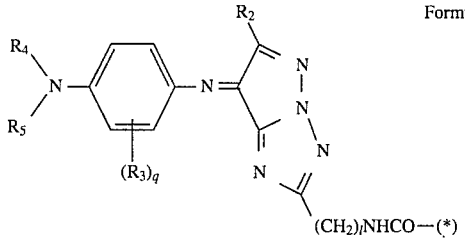

In the formula, $R_2$, $R_3$, $R_4$ and $R_5$ are the same as $R_2$, $R_3$, $R_4$ and $R_5$ as defined in the formula (III) afore-mentioned; q represents an integer of 0 to 4; l represents an integer of 1 to 3; the Dye of the above formula is bonded, at the position (*), with $[A\text{-}(J_1)_a\text{-}(X)_b]_c\text{-}J_2$- residue.

In the formula (I), A represents a 1,3-sulfur-nitrogen-containing compound residue capable of releasing $[\text{-}(J_1)_a\text{-}(X)_b]_c\text{-}J_2$-Dye upon the cleavage rection at a high temperature in the presence of a silver ion or complex thereof. A is preferably a thiazolizinyl residue represented by the following formula (V).

Formula (V)

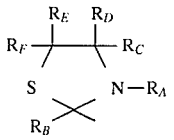

In the formula (V), $R_A$ represents a hydrogen atom, alkyl group, cycloalkyl group, aryl group, heterocyclic group, acyl group or sulfonyl group.

As an alkyl group represenyed by $R_A$, is cited a straight-chain (unbranched) or branched alkyl such as methyl, ethyl, i-propyl, t-butyl, dodecyl or 1-hexylnonyl.

As an example of a cycloalkyl group is cited cyclopropyl, cyclohexyl, bicyclo[2.2.1]heptyl or adamantyl.

As an example of an aryl group, is cited phenyl, 1-naphthyl or 9-anthranyl.

As a heterocyclic group, is cited 2-tetrahydrofuryl, 2-thienyl, 4-imidazolyl or 2-pyridyl.

As examples of an acyl group are cited a carbonyl group including an alkylcarbonyl group such as acetyl or trifluoroacetylpivaloyl and arylcarbonyl group such as benzoyl, pentafluorobenzoyl or 3,5-di-t-butyl-4-hydroxybenzoyl; an oxycarbonyl group including an alkoxycarbonyl group such as methoxycarbonyl, cyclohexyloxycarbonyl or dodecyloxycarbonyl, aryloxycarbonyl group such as phenoxycarbonyl, 2,4-di-t-amylphenoxycarbonyl or 1-naphthyloxycarbonyl and heterocyclic-oxycarbonyl such as 2-pyridyloxycarbonyl or 1-phenylpyrazolyl-5-oxycarbonyl; a carbamoyl group including a alkylcarbamoyl group such as dimethylcarbamoyl or 4-(2,4-di-t-amylpheoxy)butylaminocarbonyl and arycabamoyl such as phenylcarbamoyl or 1-naphtylcarbamoyl.

As examples of a sulfonyl group represented by $R_A$ are cited a sulfonyl group including an alkylsulfonyl group such as methanesulfonyl or trifluoromethanesulfonyl and arylsulfonyl group such as p-toluensulfonyl; and a sulfamoyl group including an alkylsulfamoyl such as dimethylsulfamoyl or 4-(2,4-di-t-amylphenoxy)butylaminosulfonyl and an arylsulfamoyl group such as phenylsulfamoyl.

These groups represented by $R_A$ each may be substituted. As examples of a subsituent thereof are cited an alkyl group, cycloalkyl group, aryl group, heterocyclic group, acyl group and sulfonyl group as represented by $R_A$ afore-described; and further are cited a halogen-substituted alkyl group such as trifluoromethyl, halogen atom, cyano group, nitro group, alkenyl group such as 2-propenyl or oleyl, hydroxy group, alkoxy group such as methoxy or 2-ethoxyehoxy, aryloxy such as phenoxy, 2,4-di-t-amylpheoxy or 4-(4hydroxyphenylsulfonyl)pheoxy, heterocyclic-oxy such as 4pyridyloxy or 2-hexahydropyranyloxy, carbonyoxy including an alkylcarbonyloxy group such as acetyloxy, trifluoroacetyloxy or pivaloyl and aryloxy such as benzoyloxy or pentafluorobenzoyloxy, uerethane group including an alkylurethane group such as N,N-dimethylurethane and arylurethane group such as N-phenylurethane or N-(p-cyanophenyl)urethanesulfonyloxy group including an alkylsufonyloxy group such as methanesulfonyl, trifluoromethanesulfonyl or dodecanesulfonyloxy and arylsulfonyloxy group such as benzenesulfonyloxy or p-toluenesulfonyloxy, amino group including an alkyl amino group such as dimethylamino, cyclohexylamino or dodecylamino and arylamino group such as anilino or p-t-octylanilino, sulfonylamino group including a alkylsulfonylamino such as methansulfonylamino, heptafluoropropanesulfonylamino or hexadecylsulfonylamino and arylsulfonylamino such as p-toluenesulfonyl or pentafluorobenzenesulfonylamino, sufamoylamino including an alkylsulfamoylamino such as N,N-dimethylsulfamoylamino group and arylsulfamoylamino group such as N-phenylsulfamoylamino, acylamino group including an alkylcarbonylamino group such as acetylamino or myristoylamino and arylcarbonylamino group such as benzoylamino, ureido group including an alkylureido group such as N,N-dimethylaminoureido and arylureido group such as N-phenylureido or N-(p-cyanophenyl)ureido, alkylthio group such as methylthio or t-octylthio, arylthio group such as phenylthio and heterocyclicthio group such as 1-phenyltetrazole-5-thio or 5-methyl- 1,3,4-oxadiazole-2-thio.

$R_A$ is preferably an alkyl or aryl group.

$R_B$ is a hydrogen atom, alkyl group, cycloalkyl group, aryl group, heterocyclic group or a group expressed as $[\text{-}(J_1)_a\text{-}(X)_b]_c\text{-}J_2$-Dye.

An alkyl group, cycloalkylgroup, aryl group and heterocyclic group represented by $R_B$ are the same as an alkyl group, cycloalkylgroup, aryl group and heterocyclic group represented by $R_A$. The $R_B$ group may be substituted by a substituent, which is the same as the substituent of an alkyl group, cycloalkylgroup, aryl group or heterocyclic group represented by $R_A$.

$R_B$ is preferably a hydrogen atom.

$R_C$, $R_D$, $R_E$ and $R_F$ independently represent a hydrogen atom, alkyl group, aryl group, heterocyclic group, carboxyl group, acyl group, sulfonyl group or sulfo group.

A hydrogen atom, alkyl group, aryl group, heterocyclic group, acyl group, or sulfonyl group represented by $R_C$, $R_D$, $R_E$ and $R_F$ are the same as a hydrogen atom, alkyl group, aryl group, heterocyclic group, acyl group, or sulfonyl group represented by $R_A$. These alkyl group, aryl group, heterocyclic group, acyl group and sulfonyl group may be substituted by a substutuent, which is the same as the substituent of the groups represented by $R_A$.

$R_C$, $R_D$, $R_E$ and $R_F$ each are preferably a hydrogen atom, alkyl group, aryl group or acyl group, more preferably, a hydrogen atom or alkyl group.

In formula (I), $J_1$ is a divalent linkage including an alkylene group such as 1,2-ethylene or 1,3-propylene and arylene group such as 1,4-phenylene or 1,5-naphthylene. These group may be substituted by a substituent, which is the same as the substituent of an alkyl group, cycloalkyl group, aryl group and heterocyclic group represented by $R_A$ of formula (V).

$J_2$ is a divalent or trivalent linkage. As a divalent linkage is cited the same one as $J_1$. As examples of a trivalent linkage are cited an alkylene group such as 1,2,2-ethylene ($—CH_2CH=$) and arylene such as 1,3,5-phenylene 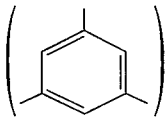

These group may be substituted by a substituent, which is the same as a substituent of an alkyl group, cycloalkyl group, aryl group or heterocyclic group represented by $R_A$ of formula (V).

In formula (I), X is a divalent linkage selected from the group consisting of —CO—, —COO—, —CONH—, $—SO_2—$, $—SO_2NH—$, $—SO_3—$, —NHCO—, $—NHSO_2—$ and —O—. X is preferably a divalent linkage selected from the group consisting of —CONH—, $—SO_2NH—$, —NHCO— and $—NHSO_2—$; a and b each are 0 or 1; c is 1 or 2, and a and b are preferably 1.

In formula (I), Dye represents a group represented by formula (II), (III) or (IV).

In formula (II), as an alkyl group represented by $R_1$ is cited the same one as an alkyl group defined in $R_A$ of formula (V). As an alkoxy group, aryloxy group, acylamino group, sulfonylamino group, carbamoyl group or sulfamoyl group is cited the same one as a substituent of an alkyl group, cycloalkyl group, aryl group or heterocyclic group represented as $R_A$ of formula (V). These groups may be substituted by a substituent, which is the same one as a substituent of an alkyl group, cycloalkyl group, aryl group or heterocyclic group represented by $R_A$ of formula (V).

As an alkyl group represented by $R_3$ of formula (II), is cited the same one as an alkyl group defined in $R_A$ of formula (V). As an acylamino group and alkoxy group are cited the same as an acylamino group and alkoxy group defined as a substituent of an alkyl group, cycloalkyl group, aryl group or heterocyclic group represented by $R_A$ of formula (V). These group may be substituted by a substituent, which is the same as a substituent of an alkyl group, cycloalkyl group, aryl group or heterocyclic group represented by $R_A$ of formula (V).

As an alkyl group, cycloalkyl group and aryl group represented by $R_4$ and $R_5$ in formula (II) are cited the same as an alkyl group, cycloalkyl group and aryl group represented by $R_A$ defined in formula (V), respectively. These group may be substituted by a substituent, which is the same as a substituent of an alkyl group, cycloalkyl group and aryl group represented by $R_A$ of formula (V).

In formula (II), $R_1$ is preferably a halogen atom, alkoxy group, acylamino group, sulfonylamino group, carbamoyl group or sulfamoyl group; and p is preferably 0, 1 or 3.

In formula (II), $R_3$ is preferably an alkyl group.

In formula (II), $R_4$ and $R_5$ are preferably an alkyl group.

In formula (II), q is preferably 1.

An alkyl group, cycloalkyl group, aryl group and heterocyclic group represented by $R_2$ of formulas (III) and (IV) are respectively the same one as defined in $R_A$ of formula (V). An alkoxy group, aryloxy group, acylamino group, sulfonylamino group and arylamino group are respectively the same as a substituent of an alkyl group, cycloalkyl group, aryl group and heterocyclic group represented by $R_A$ of formula (V). These groups may be substituted by a substituent, which is the same as a substituent of an alkyl group, cycloalkyl group, aryl group and heterocyclic group represented by $R_A$ of formula (V).

In formulas (III) and (IV), $R_2$ is preferably an alkyl group, aryl group, alkoxy group or aryloxy group, more preferably branched alkyl group.

In formulas (III) and (IV), $R_3$, $R_4$ and $R_5$ are each preferably an alkyl group and q is preferably 1.

In formulas (III) and (IV), l is preferably 1 or 2.

In formula (I) is preferable a dye-providing material by the following formula (VI) or (VII).

Formula (VI)

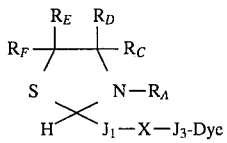

Formula (VII)

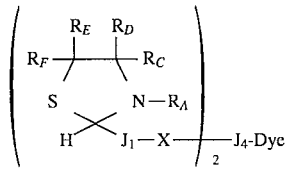

In formulas (VI) and (VII), $R_A$, $R_C$, $R_D$, $R_E$ and $R_F$ is the same as $R_A$, $R_C$, $R_D$, $R_E$ and $R_F$ defined in formula (V), respectively.

In formula (VI), $J_1$ and X is the same as $J_1$ and X defined in formula (I). $J_3$ is a divalent linkage, which is, for example, an alkylene group such as 1,2-ethylene or 1,3-propylene, or arylene group such as 1,4-phenylene or 1,5-naphthylene.

In formula (VII), $J_1$ and X is the same as $J_1$ and X defined in formula (I). $J_4$ is a trivalent linkage, which is, for example, an alkylene group such as 1,2,2-ethylene (°$CH_2CH=$) or arylene group such as 1,3,5-phenylene 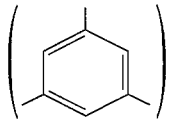

In formulas (VI) and (VII), $J_3$ and $J_4$ may be substituted by a substituent, which is the same as a substituent of an alkyl group, cycloalkyl group, aryl group and heterocyclic group represented by $R_A$ of formula (V).

In formulas (VI) and (VII), Dye represents the same as defined in Formula (II), (III) or (IV).

Among dye-providing compounds represented by formula (I) is more preferable one represented by formula (VI).

Examples of the dye-providing compound represented by formula (I) are shown as below, however, the present invention is not limited thereto.

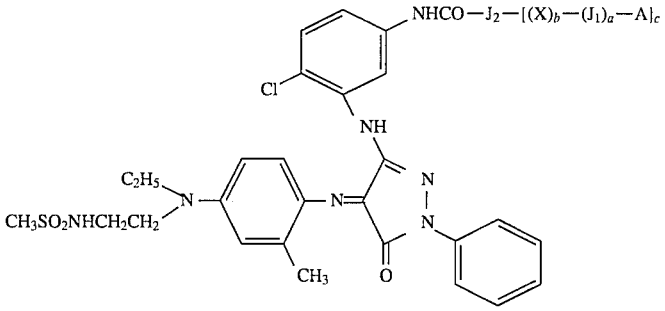
| Exemplified Compound | $-J_2-[(X)_b-(J_1)_a-A]_c$ |
|---|---|
| 1-1 | 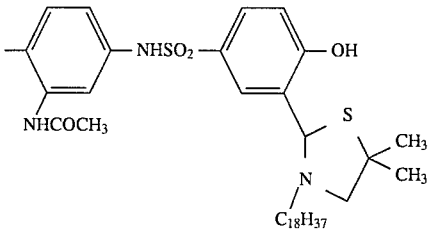 |
| 1-2 | 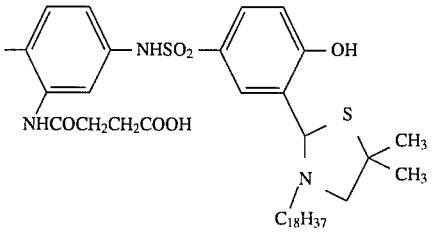 |
| 1-3 | 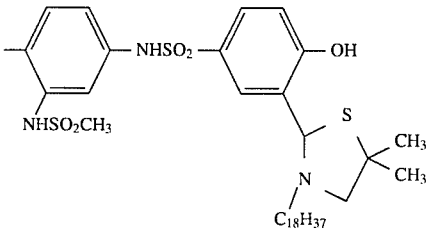 |
| 1-4 | 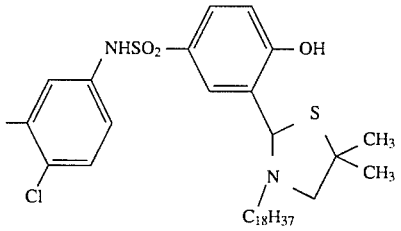 |
| 1-5 | 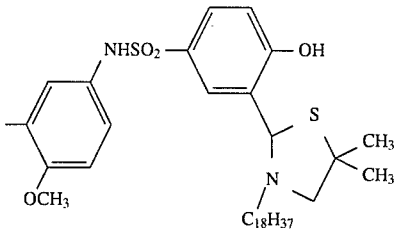 |

-continued
1-6
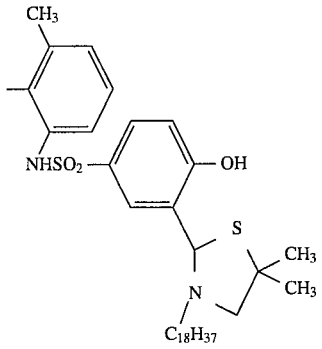
1-7
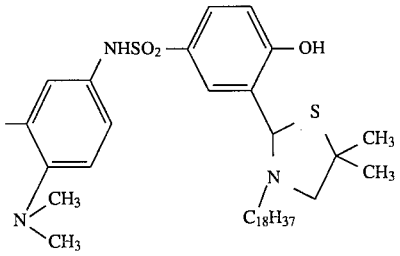
1-8
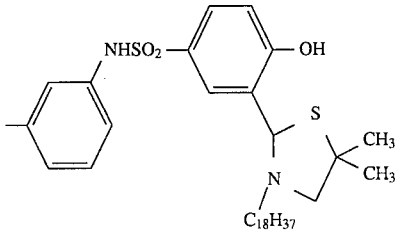
1-9
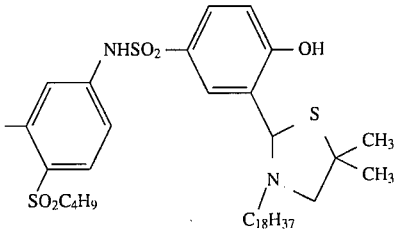
1-10
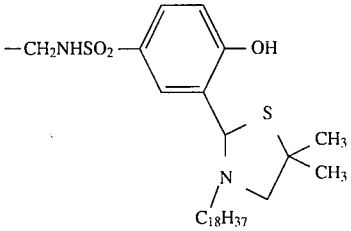
1-11
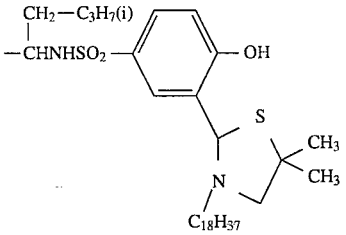

-continued
1-12
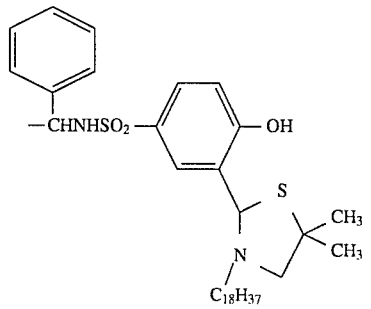
1-13
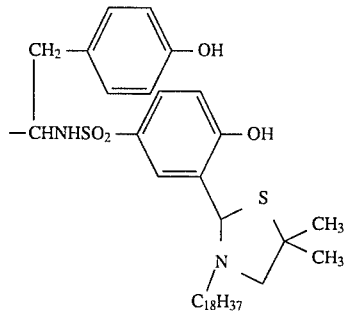
1-14
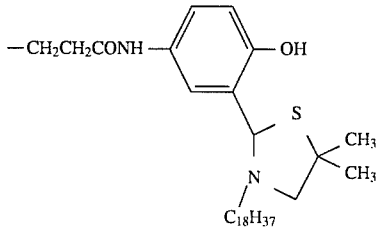
1-15
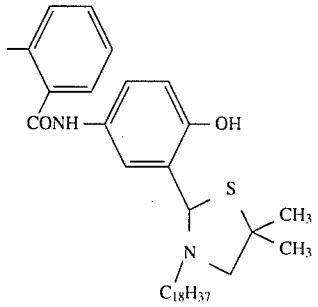
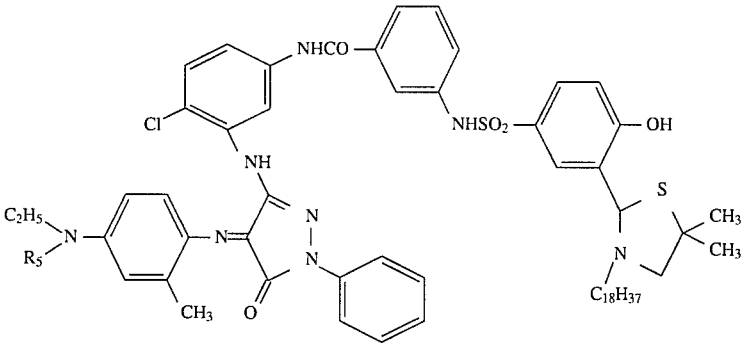
| Exemplified Compound | $R_5$ |
|---|---|
| 1-16 | $-CH_2CH_2OH$ |
| 1-17 | $-CH_2CH_2COOH$ |

-continued
| | |
|---|---|
| 1-18 | $-C_2H_5$ |
| 1-19 | $-CH_2CH_2OCH_3$ |
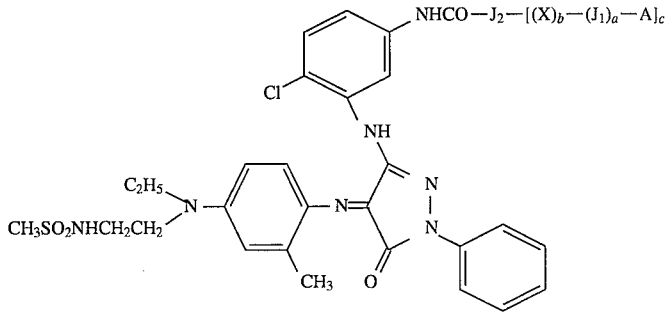
| Exemplified Compound | $-J_2-[(X)_b-(J_1)_a-A]_c$ |
|---|---|
| 1-20 | 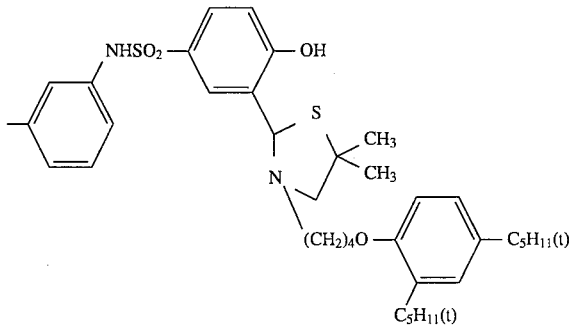 |
| 1-21 | 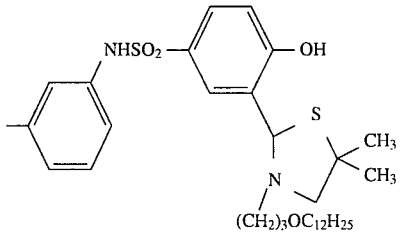 |
| 1-22 | 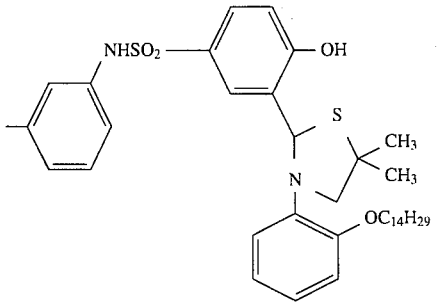 |
| 1-23 | 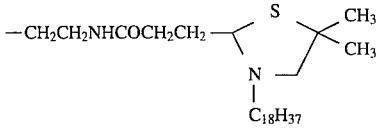 |
| 1-24 | 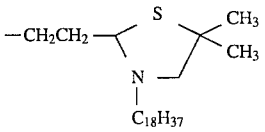 |

-continued
1-25
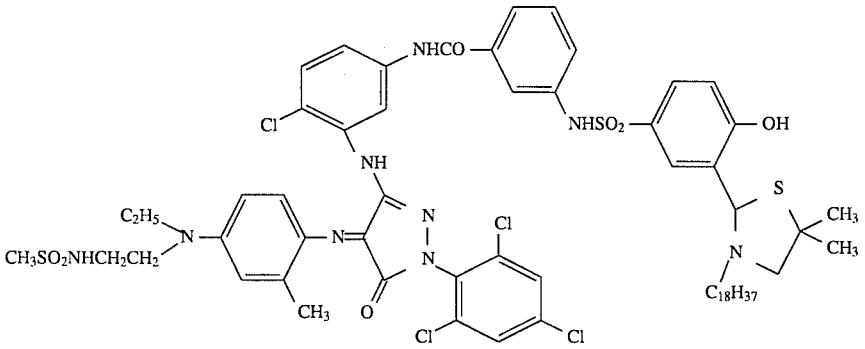
1-26
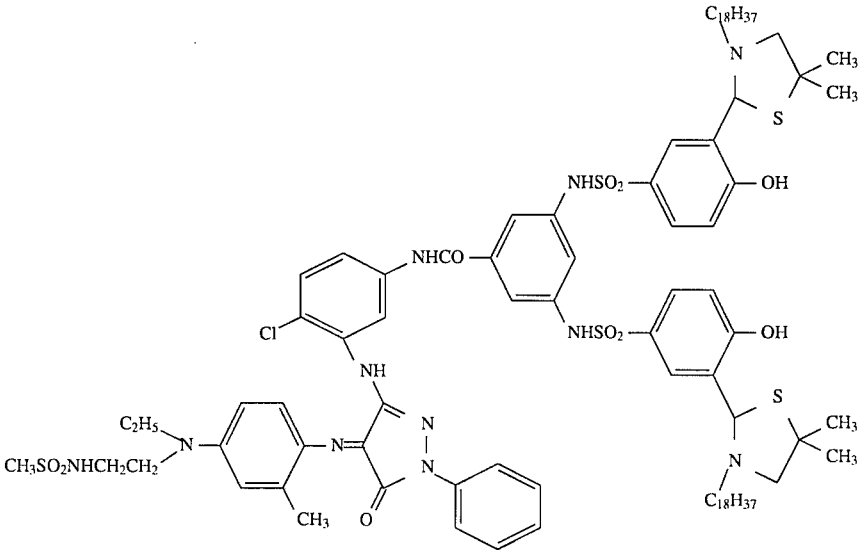
1-27
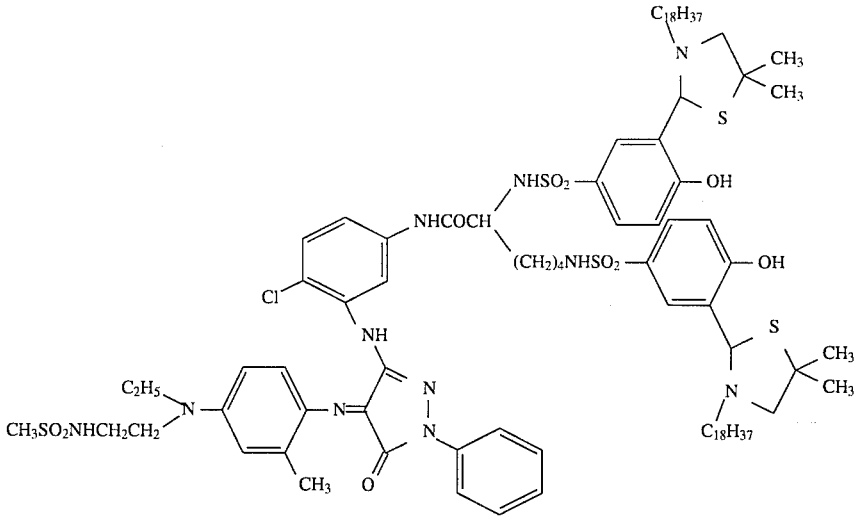

-continued
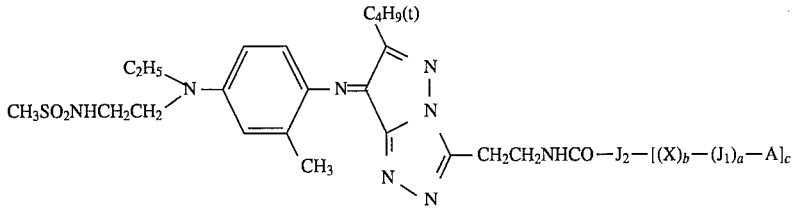
| Exemplified Compound | $-J_2-[(X)_b-(J_1)_a-A]_c$ |
|---|---|
| 2-1 | 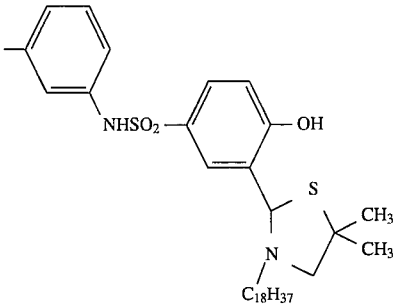 |
| 2-2 | 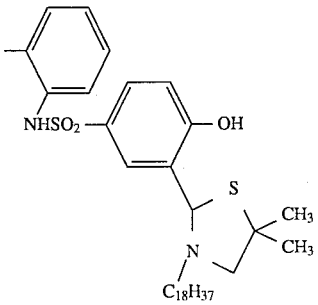 |
| 2-3 | 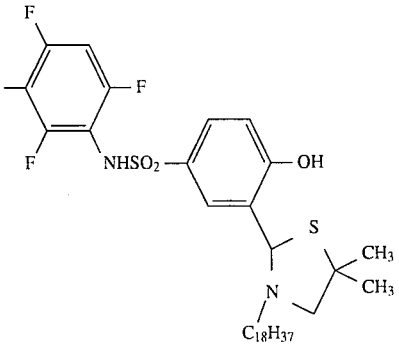 |
| 2-4 | 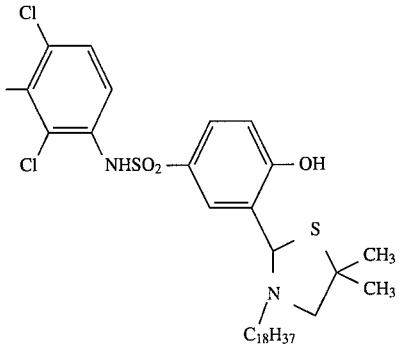 |

-continued
2-5
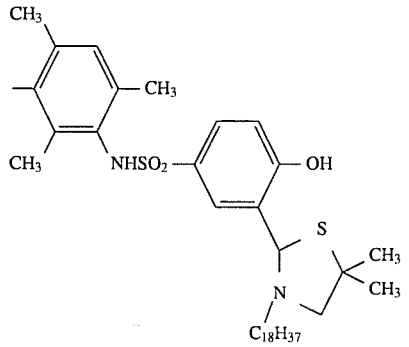
2-6
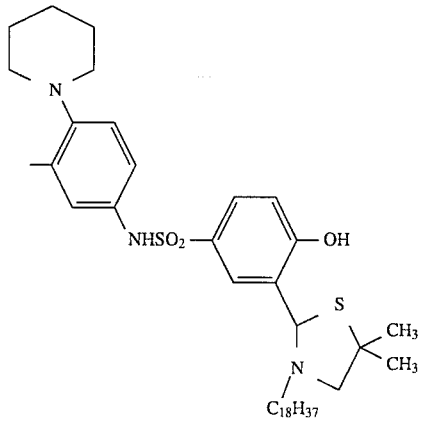
2-7
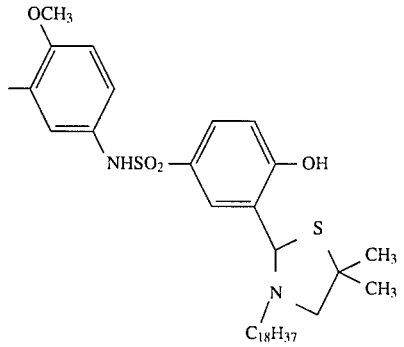
2-8
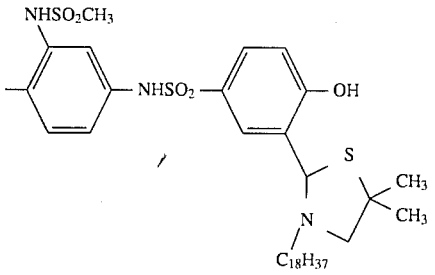
2-9
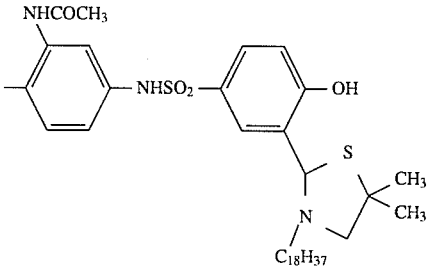

-continued
2-10
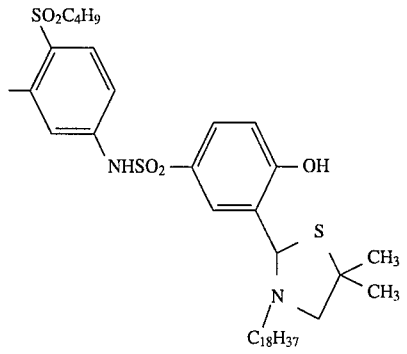
2-11
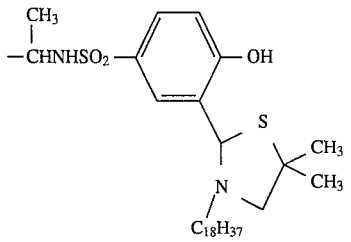
2-12
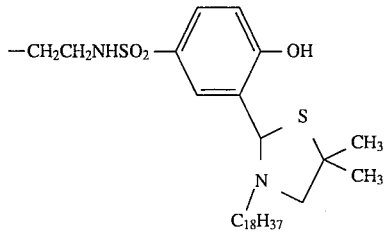
2-13
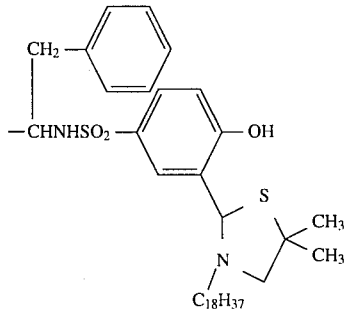
2-14
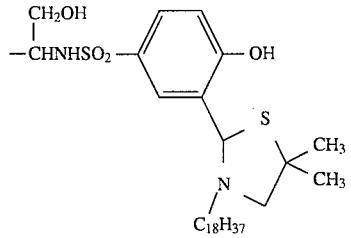

-continued
2-15
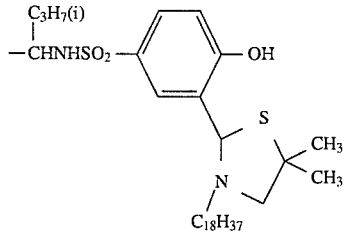
2-16
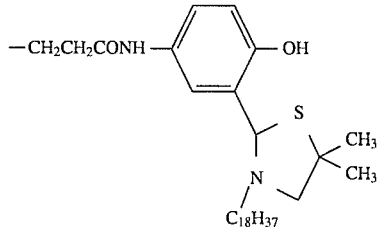
2-17
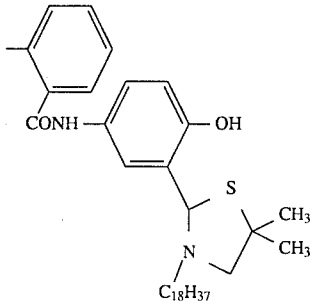
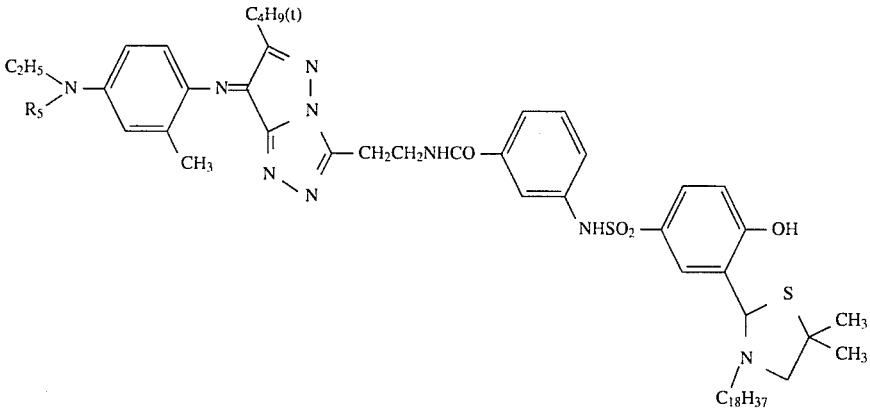
| Exemplified Compound | $R_5$ |
|---|---|
| 2-18 | $-CH_2CH_2OH$ |
| 2-19 | $-CH_2CH_2OCH_3$ |
| 2-20 | $-CH_2CHCOOH$ |
| 2-21 | $-C_2H_5$ |

-continued
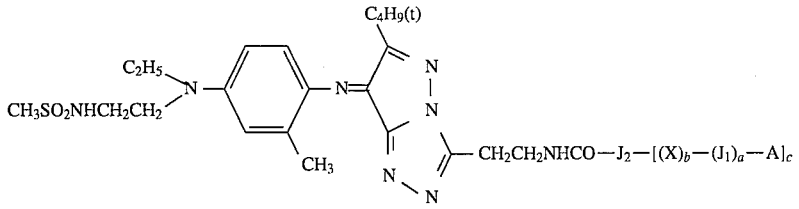
| Exemplified Compound | $-J_2-[(X)_b-(J_1)_a-A]_c$ |
|---|---|
| 2-22 | 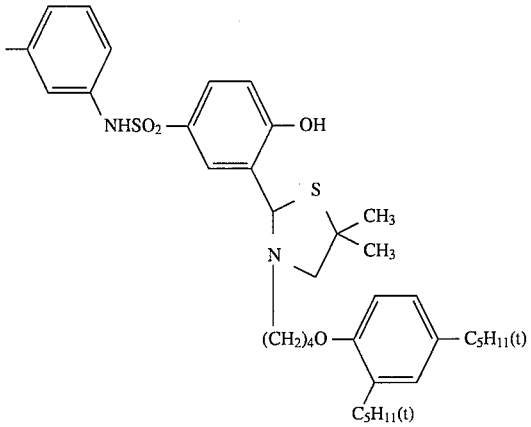 |
| 2-23 | 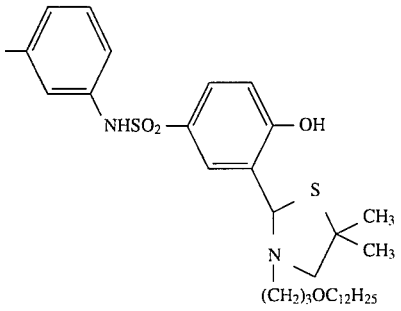 |
| 2-24 | 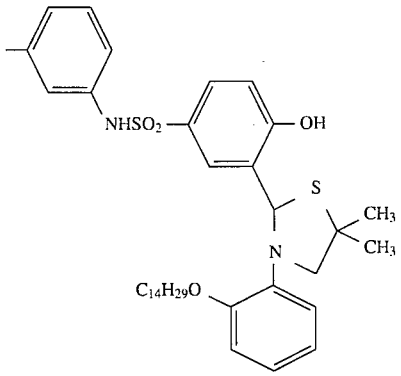 |
| 2-25 | 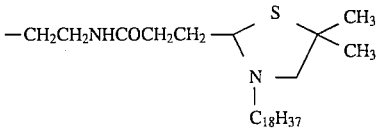 |

-continued
2-26
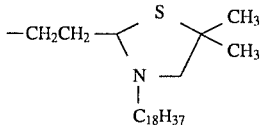
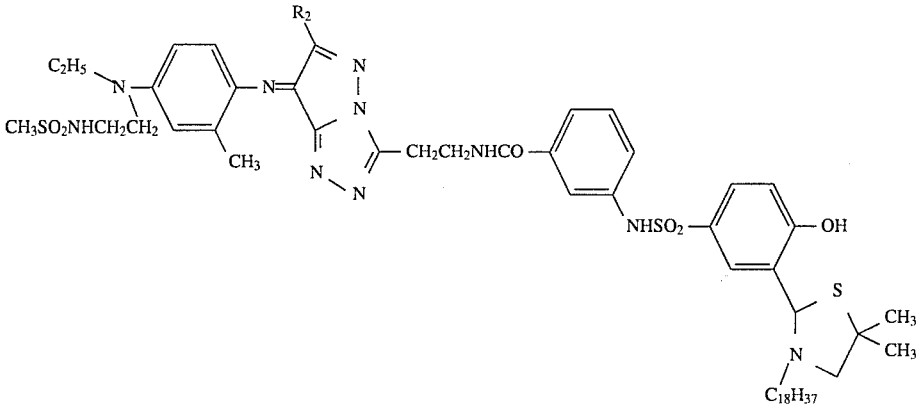
| Exemplified Compound | $R_2$ |
|---|---|
| 2-27 | $-C_3H_7(i)$ |
| 2-28 | $-CH(C_2H_5)(C_4H_9(n))$ |
| 2-29 | 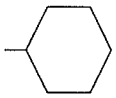 |
| 2-30 | $-CH(CH_3)CH_2OH$ $CH_2OH$ |
| 2-31 | $-CH(CH_3)CH_2OH$ $CH_3$ |
| 2-32 | 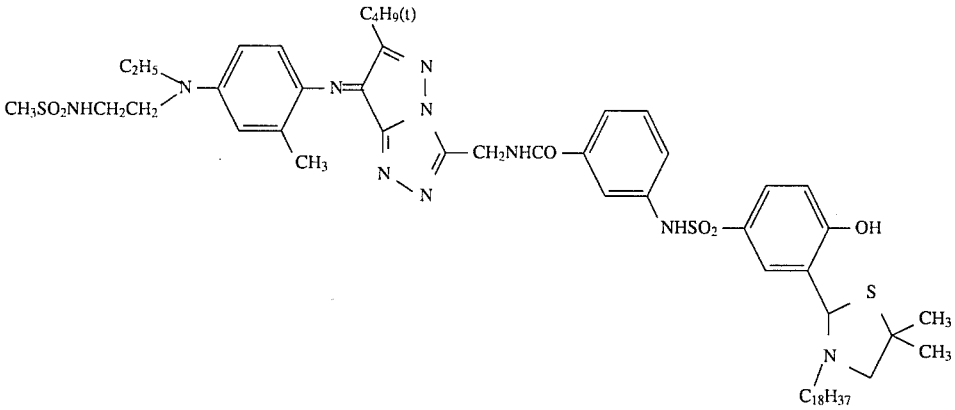 |

-continued
2-33
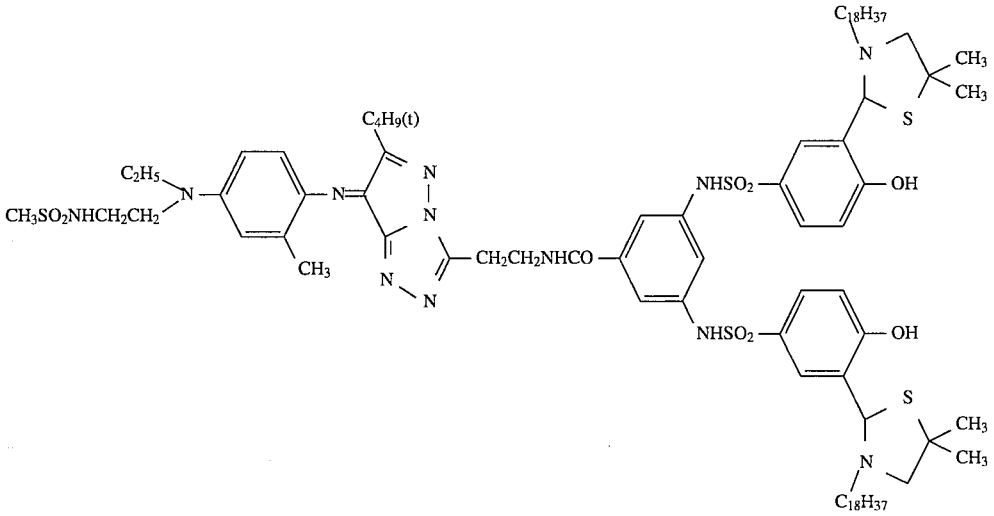
2-33
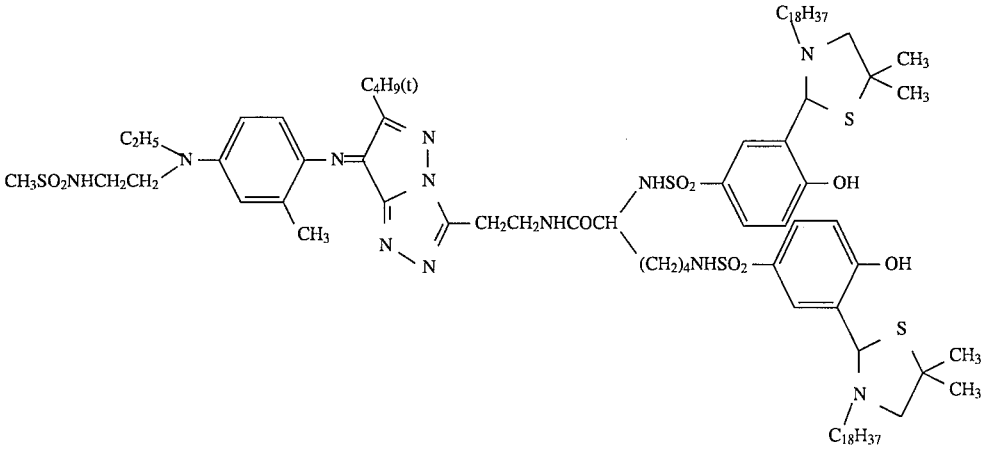
| Exemplified Compound | $-J_2-[(X)_b-(J_1)_a-A]_c$ |
|---|---|
| | 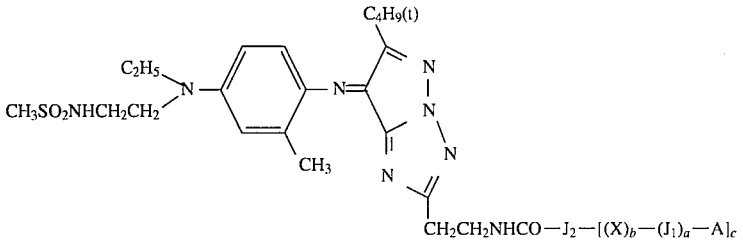 |
3-1
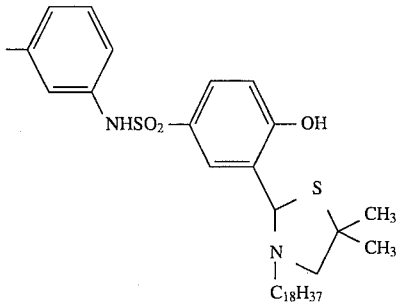

-continued
3-2
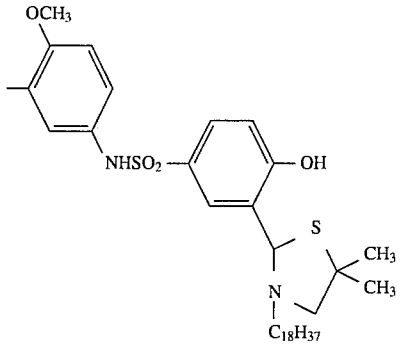
3-3
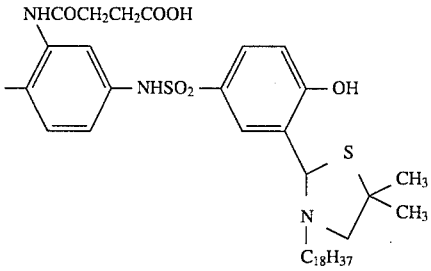
3-4
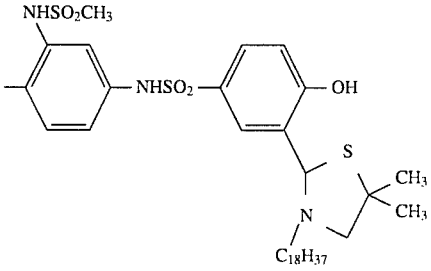
3-5
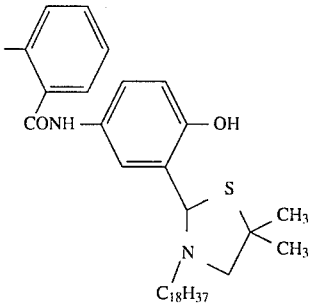

-continued
3-6
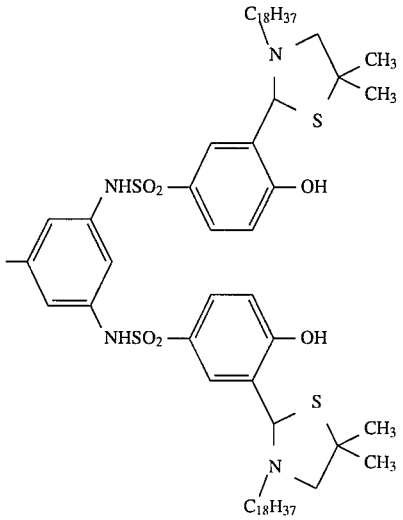
307
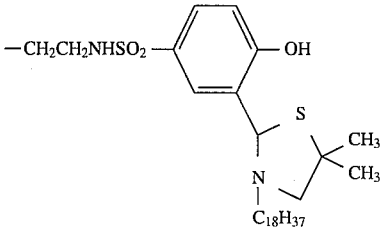
3-8
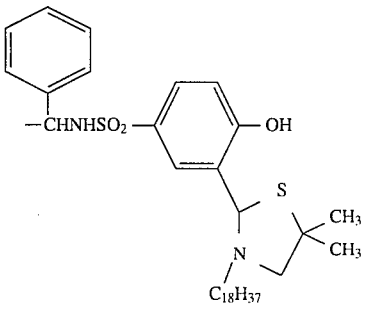
3-9
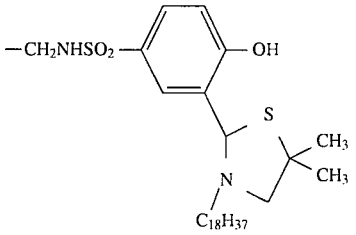
3-10
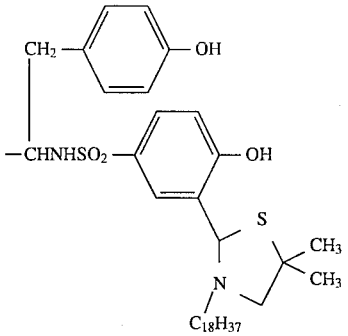

-continued 3-11

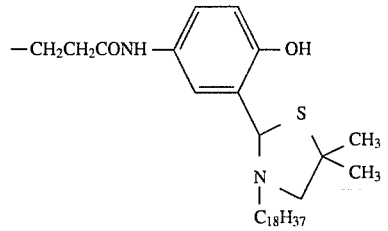

3-12

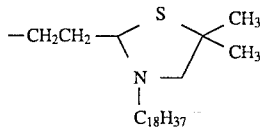

3-13

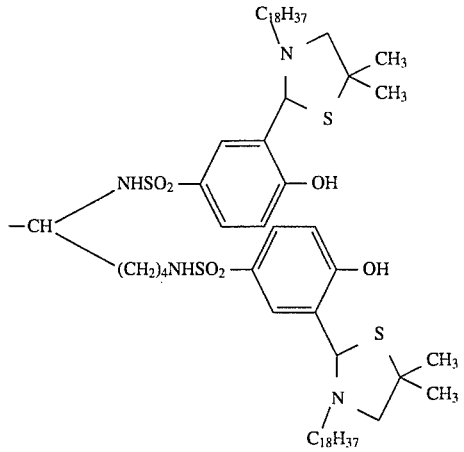

The dye-providing compound of the invention can be synthesized by a process of forming previously a dye moiety and a 1,3-sulfur-nitrogen containing compound moiety and then combining them with each other. The dye moiety and 1,3-sulfur-nitrogen moiety can be readily synthesized by a method known in the art. As to the dye moiety, for example, it can be synthesized according to the method as diclosed in U.S. Pat. Nos. 2,369,929, 2,772,162, 2,895,826 and 3,758,308, JP-A 55-163537, JP-examined 63-10818, 63-30619 and 3-18175, and EP-250,954. As to the 1,3-sulfur-nitrogen moiety, it can be synthesized according to the method as disclosed in U.S. Pat. Nos. 4.098,783, 4,332,950, 4,336,387 and 4,355,169, and J. Am. Chem. Soc. 101, 420 (1979).

Exemplanary synthesis of the dye-providing compound represented by formula (I) is shown below. A dye intermediate (a) and thiazolidine intermediate (or 1,3-sulfur-nitrogen compound residue) (b) which were used in the present synthesis were synthesized according to the method as disclosed in the afore-described references.

Synthesis of exemplified Compound 1–8

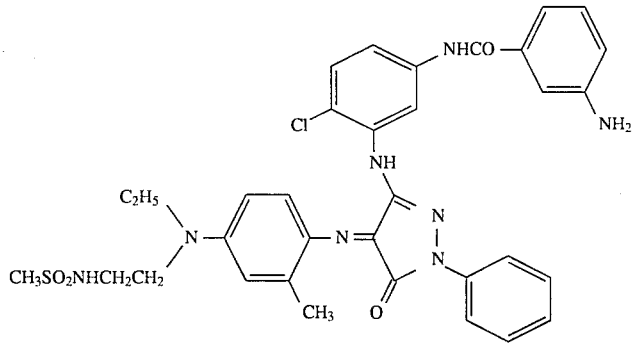

(a)

-continued

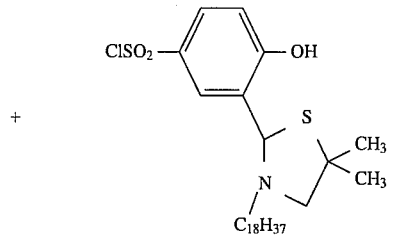

(b)

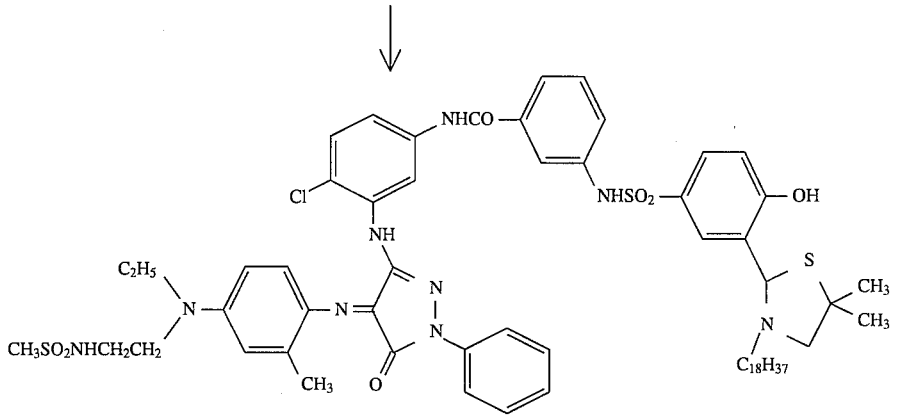

Exemplified Compound 1-8

Compound (a) of 6.9 g was dissolved in 35 ml of pyridine and thereto was added, over a period of 30 min., a solution in which 6.6 g of Compound (b) was dissolved in 70 ml of chloroform. After completing the addition, the mixture was allowed to stand at a room temperature for 5 hours. After completion of the reaction, the reaction solution was added into 300 ml of ice-cold water. After adjusting the pH to 2.0 or less with hydrochloric acid, extraction was made three times with ethyl acetate. The resulting ethyl acetate solution was washed with tap water, then, neutralized with 5% sodium carbonate aqueous solution and further washed two times with tap water. After the resulting organic layer was dried with anhydrous magnesium sulfate, organic solvent was distilled out under a reduced pressure. The resulting residue was refined by a silica-gel column chromatography to obtain compound (1–8) of 9.8 g (yield, 81%).

The chemical structure of exemplified Compound (1–8) was confirmed with NMR, IR and mass-spectrum. Further, other exemplified compounds were synthesized in a similar manner to the above.

The dye-providing materia of the invention may be used singly or in combination thereof. The amount to be used, which may be optional according to the kind thereof and the use of a heat-developable photosensitive material, is 0.05 to 10 g, preferably, 0.1 to 5 g per $m^2$ of the photosensitive material.

The dye-providing compound can be contained in a component layer of a heat-developable photosensitive material by a method optionally selected from techniques known in the art such as a method of dispersing in a hydrophilic colloidal solution with the use of a high boiling solvent such as dibutyl phthalate, dioctyl phthalate or tricresyl phthalate, a method of dissolving in a hydrophilic colloid alkaline solution and then dispersing with neutralizing with acid and a method of dispersing in a hydrophilic colloid solution in the form of solid fine particles ground. In the case when being dispersed in the form of fine particles, an average particle size is 0.05 to 10 μm, preferably, 0.1 to 5 μm.

The heat-developable photosensitive material of the invention may be applicable to one, in which, with a polymerizable compound as disclosed in JP-A 2-293753 (1990) and 2-308162 (1990), a dye-providing compound is contained a micro-capsule, which is heat-developed to cause image-wise (or reversed image-wise) polimerization of the polimerizable compound and thereby causing to change the diffusibility of the dye-providing compound to a image-receiving layer to form an image.

As photosensitive silver halide applicable in the heat-developable photosensitive material,of the invention may be usable any one known in the photographic art such as silver chloride, silver bromide, silver iodobromide, silver chlorobromide and silver iodochlorobromide.

The silver halide grains may be those having uniform halide composision within the grain or those having different halide composition between surface and interior of the grain such as core/shell type grains or multilayer-structured grains.

The silver halide grains may be monodispersed or polydispersed with respect to the grain size thereof.

The silver halide grains usable in the invention may have any form such as cubic, spherical, octahedral, dodecahedral and tetradehedral forms. Further, there may be used tabular grains having two parallel crystal faces which are larger in area than other faces, and having a ratio of grain diameter to thickness of 5 or more, as described in JP-A 58-111933 (1983) and 58-111934 (1983), and Research Disclosure (RD) No.22534.

There may be used a previously-unfogged internal latent image forming type silver halide emulsion as disclosed in U.S. Pat. Nos. 2,592,250, 3,220,613, 3,271,257, 3,317,322, 3,511,622, 3,531,291, 3,447,927, 3,761,266, 3,703,584, 3,736,140, 3,761,276, JP-A 50-8524 (1975), 50-38525 (1975), 52-15661 (1977) and 55-127549 (1980).

To silver halide emulsion grains applicable to the invention, may be added, during the course of forming the grains, metal ions such as iridium, gold, rhodium, iron and lead in the form of an optimal salt. The metal ions may be added in an amount of $10^{-7}$ to $10^{-5}$ mol per mol of silver halide.

An average grain size of the silver halide emulsion is 0.05 to 2 μm, preferably, 0.1 to 1.0 μm. To adjust a gradation, two or more silver halide emulsion having different average grain sizes with each other may be contained in a photosensitive layer.

In the invention, photosensitive silver halide can be prepared by making present an organic silver salt and converting a part thereof to photosensitive silver halide.

The silver halide emulsion can be subjected to surface chemical-sensitization with a conventional chemical sensitizer such as active gelatin, elemental sulfur, sodium thiosulfate, thiourea dioxide or sodium chloroaurate. The chemical sensitization may be carried out in the presence of a nitrogen-containing heterocyclic compound or a mercapto compound.

The silver halide emulsion may be optimally spectral-sensitized to a spectral range of blue, green red and infra-red using a sensitizing dye known in the photographic art. Exemplanary dyes are described in JP-A 59-180553 (1984), 60-140335 (1985), 60-263937 (1985), 61-65232 (1986), 61-153635 (1986), 61-153631 (1986), 62-32446 (1987), 63-61242 (1988), 63-138343 (1988), 3-163440 )1991), 4-31854 (1992), 4-34547 (1992) and 5-45833 (1993). Furthermore, as described in JP-A 62-39846 (1987), 62-86360 (1987), 62-89037 (1987), 62-147450 (1987) and 62-147451 (1987), two or more kinds of the dyes may be used in a single silver halide emulsion.

The sensitizing dye may be added in an amount of $10^{-5}$ to $10^{-2}$ mol per mol of silver halide. The dye may be added at any time during the course of preparing a silver halide emulsion. Thus, the dye may be added at the time of forming silver halide grains, removing soluble salts, prior to, during or after chemical sensitization.

These photosensitive silver halide and photosensitive silver salt-forming component may be used in an amount of 0.01 to 10 g, preferably, 0.05 to 1 g per $m^2$ of the photosensitive material.

In the heat-developable photosensitive material of the invention, an organic silver salt known in the art may be employed for the purpose of enhancing a speed or developability.

As examples of organic silver salts usable in the invention are cited silver salts of long-chained aliphatic carboxylic acids such as silver behenate and silver α-(1-phenyltetrazolethio)acetate, as disclosed in JP-A 49-52626 (1974), 52-141222 (1977), 53-4921 (1978), 53-36224 (1978), 53-37626 (1978) 53-36224 (1978) and 53-37610 and U.S. Pat. Nos. 3,330,633, 3,794,496 and 4,105,451;a silver salt of a compound having an imino group as discloded in JP-examined 44-26582 (1969), 45-12700 (1970), 45-18416 (1970) and 45-22815 (1970), JP-A 52-137321 (1977), 58-118638 (1983) and 58-118639 (1983), U.S. Pat. No. 4,123,274; and a silver salt of acetylene as disclosed in JP-A 61-249044 (1986).

Among these compounds is preferable a silver salt of a compound having an imino group, specifically, a silver salt of benzotriazole or derivative thereof. The amount of the silver salt to be used is 0.005 to 10 g, preferably, 0.01 to 5 g per $m^2$ of the photosensitive material.

In the heat-developable photosensitive material of the invention, there may be employed a reducing agent, according to the mechanism of development or dye-forming or releasing, optionally selected from reducing compounds known in the prior arts of heat-developable photosensitive materials. The reducing agent includes a reducing agent precursor capable of releasing a reducing agent upon heat-development.

As examples of the reducing agent usable in the invention are cited a p-phenylenediamine or p-aminophenol type developer, a phosphonic acid-amidophenol type developer, a sulfonamidophenol type developer, hydrazone type developer, phenols, sulfonamidophenols, pohyroxybenzenes, naphthols,hydroxybisnaphthyls, methylenebisphenols ascorbic acids, 1-aryl-3-pyrrazolidones, hydrazones and a precursor of each of the above-described reducing agents, as disclosed in U.S. Pat. Nos.3,351,286, 3,761,270, 3,764,328, 3,342,599 and 3,719,492, RD 12,146, 15,108 and 15,127, JP-A 53-135628 (1978), 56-27132 (1981) and 57-79035 (1982).

Some of the dye-providing compound may play a role as a reducing agent.

The reducing agent may be used in combination thereof. Specifically, is preferable a combination of 1-aryl-3-pyrazolidone and nondiffusible hydroquinone derivative. The amount of the reducing agent to be used is 0.01 to 100 mmol per $m^2$ of the photosensitive material.

As examples of a binder usable in the invention are cited synthetic or natural polymer including polyvinyl butyral, polyvinyl acetate, ethyl cellulose, polymethaacrylate, polyvinyl alcohol, gelatin, gelatin derivative such as phthalated gelatin, cellulose derivative, protein starch and arabic gum. These material may be used singly or in combination thereof.

Among these, gelatin is used preferably. As a gelatin is used a alkali-processed gelatin, acid-processed gelatin, or a gelatin derivative such as phenylcarbamoyl-modified gelatin and phthalated gelatin. The gelatin may be used in combination thereof or in combination with another water-soluble polymer. The binder may be used in an amount of 0.1 to 50 g, preferably, 1 to 20 g per $m^2$ of the photosensitive material.

The binder preferably be hardened with a hardener conventionally used in the photographic art. As examples of a hardener are cited a vinylsulfone type hardener, epoxy type hardener, N-methylol type hardener and halogen-substituted s-triazine type hardener. A polymer hardener may also be usable.

In addition to the foregoing, the following additives may be optionally used in the heat-developable photosensitive material of the invention.

Themal solvent:

A thermal solvent is used for the purpose of accelerating the dye transfer. Thus, the thermal solvent is a compound capable of being liquidfied at the time of development, which enhances heat-development and dye transfer. The thermal solvent preferably be solid at an ordinary temperature.

As a thermal solvent usable in the invention are cited compounds as described in U.S. Pat. Nos. 3,347,675, 3,667,959, 3,438,776 and 3,666,477, RD 17,643, JP-A 51-19525 (1976), 53-24829 (1978), 53-60223 (1978), 58-118640 (1983), 58-198038 (1883), 59-229556 (1984), 59-68730 (1984), 59-84236 (1984), 60-191251 (1985), 60-232547 (1985), 60-14241 (1985), 61-52643 (1986), 62-78554 (1987), 62-42153 (1987), 62-44737 (1987), 63-53548 (1988), 63-161446 (1988), 1-224751 (1989) and 2-863 (1990).

Among the foregoing thermal solvents is preferable a water-insoluble thermal solvent. As examples thereof are cited compounds as described in JP-A 62-136645 (1987), 62-139545 (1987), 63-53548 (1988), 63-161446 (1988), 1-224751 (1989), 2-863 (1990), 2-120739 (1990) and 2-123354 (1990).

The thermal solvent may be contained in any layer such as a photosensitive silver halide emulsion layer, an interlayer, a protective layer or an image-receiving layer of a image receiving material. The amount to be contained is 5 to 500%, preferably, 10 to 200% by weight based on the binder.

Development-accelerating agent:

As a development-accelerAting agent is usable a compound capable of releasing a development-accelerating agent, as described in JP-A 59-177550 (1984), 59-111636 (1984), 59-124333 (1984), 61-72233 (1986), 61-236548 (1986) and 1-152454 (1989).

Fog inhibitor:

As examples of a fog inhibitor are cited a higher aliphatic acid as described in U.S. Pat. No. 3,700,457; N-halogen compound as described in JP-A 51-47419 (1976); a compound capable of releasing a mercapto compound as described in U.S. Pat. No. 3,700,457 and JP-A 51-50725 (1976), 2-297548 (1990) and 2-282241 (1990); a arysulfonic acid as described in 49-125016 (1974); an oxidizing agent as described in British Patent 1,455,271 and JP-A 50-101019 (1975); a thiosulfinic acic and thisukfonic acid as described in JP-A 53-19825 (1977); a thiouracil as described in JP-A 51-3223 (1977); sulfur as described in JP-A 51-26019 (1976); a disulfide and polysulfide as described in JP-A 51-42529 (1976), 51-81124 (1976) and 55-93149 (1980); rosin and diterpene as described in JP-A 51-57435 (1976); a polymer acid having a carboxy or sulfonic acid group as described in JP-A 51104338 (1976); a thiazoli-thione as described in U.S. Pat. No. 4,138,265; a triazole as described in JP-A 54-51821 (1979), 55-142331 (1980) and U.S. Pat. No. 4,137,079; a thiosulfinic acid ester as described in JP-A 55-140883 (1980); a di- or trihalogenate compound as described in JP-A 59-46641 (1984), 59-57233 (1984) and 59-57234 (1984); a thiol compound as described in JP-A 59-111636 (1984); and a hydrquinone derivative as described in JP-A 60-198540 (1985) and 60-227255 (1985).

As another example of the fog inhibitor is cited a fog inhibitor having a water-solubilizing group as described in JP-A 62-78554, a polymeric fog inhibitor as described in 62-121452 (1987) or a fog inhibitor having a ballast group as described in JP-A 62-123456 (1987).

A water-soluble halide such as potassium bromide, potassium iodide or sodium chloride can be used as a fog inhibitor. The above-described fog inhibitors may be contained in a heat-developable photosensitive material or an image receiving material.

Base precursor:

As examples thereof are cited a compound capable of releasing a basic compound through decarboxylation by heating (such as guanidine trichloroacetic acid), a compound capable of releasing an amine throgh intramolecular nucleophilic substitution, and a base precursor capable of releasing a base through the reaction of an aqueous-insoluble basic metal compound (such as zinc hydroxide) with a compound capable of forming a complex with the metal ion (such as picoline), as described in JP-A 56-130745 (1981), 59-157637 (1984), 59-166943 (1984), 59-180537 (1984), 59-174830 (1984), 59-195237 (1984), 62-108149 (1987), 62-174745 (1987), 62-187847 (1987), 63-97942 (1988), 63-96159 (1988) and 1-68746 (1989).

Silver ion scavenger:

There can be used silver ion scavengers known in the diffusion transfer art such as a physical development nucleus as described in JP-A 63-163345 (1988), a diffusion-proof compound capable of forming a complex with a silver ion and a compound capable of foming a sparingly soluble silver salt.

Silver halide solvent:

A compound as decribed in JP-A 62-283335 (1987) pages 3 to 11.

Silver ion complexing agent:

A bipyridine as described in 63-309948.

In addition to the foregoing, the heat-developable photosensitive material of the present invention may contain various photographic additives known in the art such as an aqueous-soluble or hydrphobic filter dye, colloidal silver, fluorescent brightener, antistatic agent, surfactant including anionic, cationic, nonionic and fluorine-containing anionic ones, inorganic or organic matting agent, anti-discoloring agent, UV absorbent, and white-background-toning agent. These additives are described in RD 17029 and 29963, JP-A 62-135825 (1987) and 64-13546 (1989).

The additives may be contained in not only a photosensitive layer but also any component layer such an interlayer, subbing layer, protective layer or backing layer.

In the case when the heat-developable photosensitive matrerial comprises two or more photosensitive layers, an interlayer may be provided between two photosensitive layers for preventing color mixing. The interlayer generally comprises a hydrophilic colloid such as gelatin. For the purpose of preventing effectively color-mixing, further, the interlayer may contain a reducing agent such as a ballasted hydroquinone derivative to prevent interlayer-moving of an oxidation product of a reductant or a silver ion-scavenger to prevent the diffusion of silver ions.

In the heat-developable photosensitive material of the invention, there is employed a support, for example, transparent or opaque plastic film such as polyethylene terephthalate film or polyethylene naphthalate film, coated paper such as art paper, cast-coated paper and baryta paper, polyethylene-laminated paper and a support coated thereon with electron beam-hardenable resin.

The heat-developable photosensitive material comprises (a) a photosensitive silver halide emulsion, (b) a reducing agent, (c) binder and (d) a dye-providing compound. These component compounds may be contained either in a single component layer or dividedly in two or more layers. For example, components (a), (b) and (c) are contained in a layer and (d) contained in an adjacent layer; or (a), (c) and (d) are contained in a layer and (b) contained in another layer.

The heat-developable photosensitive material of the invention may comprise at least two photosensitive layers having substantially the same spectral sensitivity with each other and speed different each from the other (thus, a low speed layer and high speed layer).

In the case when the heat-developable photosensitive material of the invention is used as a full color image recording material, the photosensitive material comprises conventionally three photosensitive layers different in spectral sensitivity, in each of which a dye having different color (hue) from each other is formed or liberated. In this case, generally, a blue-sensitive layer (B), green-sensitive layer (G) and red-sensitive layer (R) are in combination with a yellow dye (Y), magenta dye (M) and cyan dye (C), respectively (i.e., B-Y/G-M/R-C); however, the present invention is not limited to this combination and any combination may be feasible. One combination is (B-C)/(G-M)/(R-Y) and another one is (Infrared-sensitive-C)/(G-Y)/(R-M). As described in JP-A 4-329541 (1992), the invention is applicable to a heat-developable photosensitive material comprising two photosensitive layers having different spectral sensitivity in the infrared region and one photosensitive layer having a sensitivity in the red region. As described in JP-A 60-162251, further, the invention is applicable to a system in which a black image is formed using a diffusible dye.

The heat-developable photosensitive material of the invention may be provided, besides a photosensitive layer, with a subbing layer, interlayer, protective layer, filter layer, backing layer or peeling layer.

In the case when the heat-developable photosensitive material of the invention is applied to a dye transfer system, there is preferably employed a image-receiving material having a dye-receiving layer. The image receiving material comprises a support having thereon an image receiving layer having ability of receiving a dye. The support itself may be an image receiving layer capable of dye-receiving. The imge receiving layer is classified into two types, thus, one is that a binder of the layer is capable of dye-receiving, and another one is that a mordant capable of dye-receiving is contained in the binder.

In the case when the binder is capable of dye-receiving, as materials used therefor, a polymer having a glass transition temperature of 40° to 250° C. is preferable, such as a synthetic polymer having a glass transition temperature of 40° C. or higher as described in "Polymer Handbook", 2nd ed., edited by J. Brandrup and E. H. Immergut, John Wiley & Sons, and a polymer having a molecular weight of 2,000 to 200,000 is usable in general. These polymer may be used singly or in combination thereof. The polymer may be a copolymer having two or more kinds of repeating units. As examples thereof are cited a polyvinyl chloride, polyester, polycarbonate, polyvinylidene chloride and polyether.

The image receiving material in which a mordant is contained in a hydrophilic binder of an image receiving layer is also preferably used. As the mordant is preferable a polymer containing a tertiary amine or quaternary ammonium salt such as a polymer mordant containing a quaternary ammonium group as described in JP-A 48-75237 (1973), 50-61228 (1975), 50-73440 (1975), 53-129034 (1978), 54-145529 (1979), 55-142339 (1980), 56-161410 (1981), 59-219745 (1984), 62-30249 (1987) or 62-34159 (1887); a polyvinyl pyridine type mordant as described in U.S. Pat. No. 3,249,393 and JP-A 60-23851; a poluvinyl imidazole type as described U.S. Pat. No. 4,115,124, British Patent 2,056,101 and 2,093,041, JP-A 59-55436 (1984), 60-23854 (1985), 60-60643 (1985), 60-118834 (1985), 60-122941 (1985) and 60-235124 (1985); a mordant in which a group having mordant ability is grafted as described in JP-A 47-3689 (1972); a combination use of a tertiary amine type mordant and quaternary ammonium salt type mordant as described in JP-A 60-57836; a mordant having an image-stabilizing group as described in JP-A 63-198051 (1988) and 2-32335 (1990).

As a binder used for holding the mordant is preferably employed a hydrophilic binder such as gelatin or polyvinyl alcohol.

The image receiving material used in the invention may have on a support a single image receiving layer, or plural component layers in which all or a part of the layers are image receiving layer(s).

In the case when the image receiving material has an image receiving layer on a support, the support may be either a tranparent support or reflective one. As examples thereof are cited a polyethylene phthalate or polypropylene support, or one in which a white pigment such as barium sulfate or titanium dioxide is contained; a laminated paper coated with a thermoplastic resin (such as polyethylene) containing a white pigment on a paper support such as art paper, cast-coated paper or baryta paper; cloth, glass or foil of metal such as alumminium. Furthermore, there may be employed a support having thereon a pigment-containing resin coat hardened with an electron beam or a reflective support having the second kind diffusion relectivity.

In the case when a paper support is employed as a support of the heat-developable photosensitive material of the invention and/or image receiving material, is preferable a paper support coated on both sises thereof with polyethylenen, more preferably, at least one of the coated layers contains titanium dioxide in polyethylene layer.

Raw paper of the polyethylene-coated paper support is preferable to be excellent in surface flatness. The surface on which a dye receiving layer or photosensitive layer is coated has preferably a Beck's smoothness as specified in JIS-P-8119 of 50 sec. or more; more preferably, 100 sec or m In a filter waviness curve determined, at a cut-off value of 0.8 mm, from a sectional curve obtained by the surface measurement in accordance with JIS-B-0610, when a maximum filter waviness is measured with respect to optional 100 points, it is preferable that there are four points or less having a maximum waviness of not less than 4 μm; in this case, a center line-averaged roughness (Ra) is preferably 3 μm or less.

The polyethylene-coated paper above-described is preferably to have constitution or characteristics as decribed JP-A 4-321043 (1992) pages 4–5.

The heat-developable photosensitive material of the invention may be a mono-sheet type one which comprises a support previously provided thereon a photosensitive layer and an image receiving layer, as described in RD 15108, JP-A 57-198458 (1982), 57-207250 (1982) and 61-80148 (1986).

Various additives known in the art may be added into the image receiving material of the invention. As examples thereof are cited an antistain agent, UV absorbent such as a benzophenone compound or benzotriazole compound as described in JP-A 60-130735 (1985) and 61-153638 (1986); a fluorescent brightener such as a diaminostylben compound as described in JP-A 61-143752 (1986) and a compound as described in JP-A 63-147166 (1988); a image stabilizing agent as described in JP 59-182785 (1984) and 61-159644 (1986); a develpment accelerating agent; a fog inhibitor such as KBr, NaCl, KI or a nitrogen-containing heterocyclic compound including benzotriazole derivative and 1-phenyl-5-mercaptotriazole derivative; a pH adjusting agent such as an acid, acid-precursor, base or base-precursor; a thermal solvent; a fluorine-containing organic compound, oil drop, a surfactant; a hardener; a polymer latex as described in 61-156045 (1986), matting agent and various transition metal ions.

The heat-developable photosensitive material and image receiving material of the invention may be provided with a backing layer for the purpose of adjusting curl balance or making an improvement in slipping property. These are optionally selected according to the use and the constitution thereof.

The heat-developable photosensitive material of the invention is exposed according to a known means suitable for the spectral sensitivity of the photosensitive material.

As exposing means, a tungsten lamp, halogen lamp, xenon lamp, mercury lamp, CRT light source, FO-CRT light source, light emission diode and laser light source such as gas-laser, dye-laser, YAG laser and semiconductor-laser may be used singly or in combination thereof. Further, a combined light source of a semiconductor laser and SHG element (Second high frequence wave-generating element) may be used.

An exposing time is variable depending on an exposing manner such that an overall exposure is made per picture or an exposure is made digitally per picture element. In the former case, it is 0.001 to 10 sec. and, in the latter case, $10^{-8}$ to $10^{-2}$ sec. When digitally exposed, one exposure may be made per one picture element or multiple exposure may be made by overlapping a plurality of exposure. In the case of multiple exposure, an exposure may be made by shifting a picture range little by little.

The heat-developable photosensitive material of the invention is, after exposure or simultaneously with exposure, subjected to heat development at 60° to 200° C. (preferably, 70° to 170° C.) for a period of 1 to 100 sec. (preferably, 2 to 60 sec.) to form a dye image. Transfer of a diffusible dye to an image receiving material may be made simultaneously with heat development by contacting an image receiving layer-side of the image receiving material with a photosensitive layer-side of the photosensitive material, or, after being heat-developed, the transfer of the dye may be made by contacting the image receiving material with the photosensitive material.

Prior to exposure, the photosensitive material may be preliminarily heated at a temperature of 50° to 150° C., or immediately before development, at least one of the photosensitive material and image receiving material may be preliminarily heated at a temperature of 80° to 120° C.

Further, heat development may be made by supplying a small amount of water to the photosensitive material or image receiving material immediately before the development and then superposing both of them (or contacting one with the other) to be developed. In this case, the water may be water itself or a solution such as an aqueou alkaline solution or aqueous solution containing a surfactant or thermal solvent as afore-described. The amount of water to be supplied is preferably within a range of the maximum swelling thickness (thus, it is an amount necessary for reaching the maximum swollen layer thickness). The water may contain an additive known in the art such as an antimold, development accelerator, fog inhibitor or brightener.

When the heat-developable photosensitive material of the invention is developed, a heating means known in the art may be applied thereto. For example, there may be applied a heat-development technique of contacting with a heated block or plane or with a heated roller or drum, passing through an environment maintained at a high temperature, using a high-frequency heating or employing Joule-heat produced by applying an electric current through an exothermic conductive substance such as carbon black provided on a back side of the photosensitive material or image receiving material.

A heating pattern may be applied, at the time of heat development, optionally by a process such as heating overall at a constant temperature; heating at a higher temperature in the initial step of the development and subsequently at a lower temperature or in a reversed manner thereof; changing temperature ranges over three or more steps; or changing the temperature continuously. As described in JP-A 63-250646 (1988), after being preliminarily developed at a lower temperature to cause silver-developing to an extent, the photosensitive material may be subjected to thermal development so as to cause preferentially silver development prior to the dye-releasing reaction.

EXAMPLES

Preparation of heat-developable photosensitive material:

On a side of a titanium dioxide containing layer coated on a paper support having a thickness of 100 μm, on both sides of which are laminated with polyethylene (a polyethylene layer on one side thereof containing titanium dioxide in an amount of 10% by weight), the following component layers were coated to prepare a heat-developable photosensitive material 101. The amount of each material to be added was expressed in terms of an amount per $m^2$ of a photosensitive material and the amount of silver halide emulsion was converted to that of silver.

| | |
|---|---|
| First layer: | |
| Gelatin | 2.0 g |
| Blue-sensitive silver halide emulsion | 1.3 mmol |
| Dye-providing compound (M-1) | 0.63 mmol |
| Surfactant-1 | 0.14 g |
| High boiling solvent-1 | 1.9 g |
| Second layer: | |
| Gelatin | 1.0 g |
| Zinc hydroxide (av. particle size, ca. 0.2 μm) | 10 mmol |
| Surfactant-1 | 0.07 g |
| Surfactant-2 | 0.004 g |
| 1-Phenyl-4,4-dimethyl-3-pyrazolidone (Reducing agent) | 4 mmol |
| Hardener-1 (added immediately before coating) | 0.15 g |

Chemical formulas of additives and preparation of photosensitive silver halide emulsion are shown as below. The dye-providing compound was dispersed in an aqueous gelatin solution along with a high boiling solvent.

Surfactant-1: Sodium tri-i-propylnaphthalene sulfonate

Surfactant-2: Sodium di(2-ethylhexyl)-sulfosuccinate

High boiling solvent: Di(2-ethylhexyl)phthalate Hardener: Mixture of $C(CH_2SO_2CH{=}CH_2)_4$ and $NH_2CH_2CH_2SO_3K$ (molar ration, 1:0.75)

Preparation of blue-sensitive silver halide emulsion:

A silver iodobromide emulsion containing cubic grains having an average size of 0.4 μm and iodide content of 2 mol % was optimally chemical-sensitized with sodium thiosulfate in the presence of the following sensitizing dye-1 (0.5 mmol/mol AgX) and 4-hydroxy-6-methyl-1,3,3a,7-tetrazaindene (HMT, 0.12 g/mol AgX). After completing chemical sensitization, HMT (1 g/mol AgX) was further added thereto.

M-1

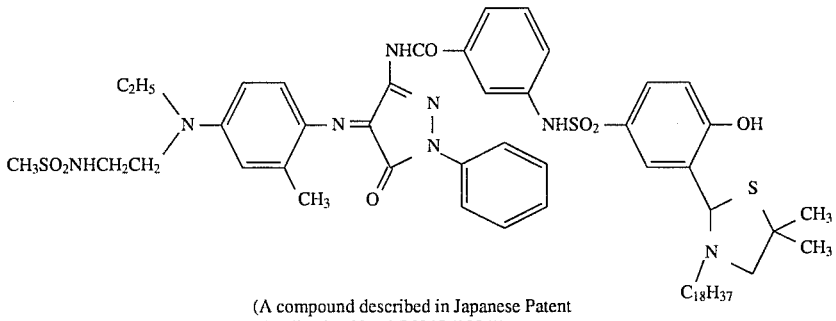

(A compound described in Japanese Patent Application No. 6-76045 (1994))

Sensitizing dye-1

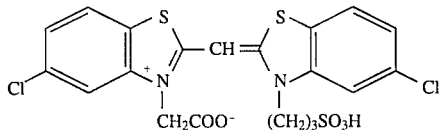

The resulting heat-developable photosensitive material was aged at 40° C. and 60% R.H. for 2 days so as to be hardened to a desired extent. The surface pH of the photosensitive layer-side of the photosensitive material was measured with a flat electrode to be 6.1.

Next, photosensitive material samples 102 to 112 were prepared in the same manner as sample 101, except that a dye- providing compound (M-1) of the first layer was replaced by a dye-providing compound as shown in Table 1, in an equimolar amount.

Preparation of dye receiving material:

On a side of a titanium dioxide containing layer coated on a paper support having a thickness of 200 μm, on both sides of which are laminated with polyethylene (a polyethylene layer on one side thereof containing titanium dioxide in an amount of 10% by weight), the following component layers were coated to prepare a dye receiving material. The amount of each additive was expressed in terms of an amount per $m^2$ of a dye receiving material.

| | |
|---|---|
| First layer | |
| Gelatin | 0.6 g |
| Surfactant-1 | 0.02 g |
| Potassium picolinate | 0.5 g |
| Second layer | |
| Gelatin | 1.8 g |
| Surfactant-1 | 0.02 g |
| Surfactant-2 | 0.01 g |
| Dye mordant | 2.8 g |
| Potassium picolinate | 1.2 g |
| Third layer | |
| Gelatin | 0.5 g |
| Potassium picolinate | 0.8 g |
| Surfactant-1 | 0.01 g |
| Surfactant-2 | 0.02 g |
| Hardener-1 | 0.10 g |
| Silicon oil | 0.02 g |
| Matting agent (Silica having av. particle size of 6 μm) | 0.01 g |

The dye mordant used is as follows.

-continued

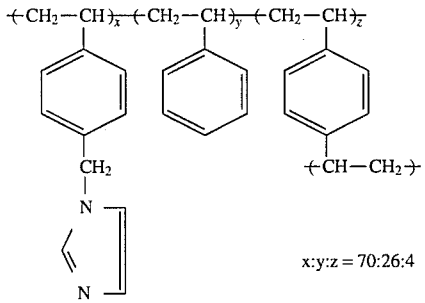

x:y:z = 70:26:4

Evaluation of heat-developable photosensitive material:

Resuting photosensitive material samples 101 to 112 were exposed to light and then immersed in water for two seconds. Thereafter, an image receiving layer of the dye receiving material was superposed on a photosensitive layer side of the photosensitive material and heating was applied thereto at 90° C. for 20 sec. The dye receiving material was peeled off and a transferred magenta dye image was obtained on the image receiving layer-side. Separately, after the heat-developable photosensitive material was aged at 40° C. and 80% R.H. for five days, a magenta transfer image was obtained in the same manner as above. A reflection density of a dye image obtained on each dye image receiving material was measured with green monochromatic light to determine a maximum and minimum densities ($D_{max}$, $D_{min}$). Results thereof are shown as below.

TABLE 1

| Sample No. | Dye providing compound | Fresh $D_{max}$ | Fresh $D_{min}$ | Aged $D_{max}$ | Aged $D_{min}$ | Remarks |
|---|---|---|---|---|---|---|
| 101 | M-1 | 0.19 | 1.35 | 0.21 | 0.55 | Comp. |
| 102 | 1-1 | 0.16 | 1.47 | 0.15 | 1.45 | Inv. |
| 103 | 1-5 | 0.14 | 1.48 | 0.16 | 1.47 | Inv. |
| 104 | 1-8 | 0.15 | 1.45 | 0.15 | 1.47 | Inv. |
| 105 | 1-10 | 0.16 | 1.42 | 0.15 | 1.41 | Inv. |
| 106 | 1-26 | 0.14 | 1.35 | 0.14 | 1.36 | Inv. |

TABLE 2

| Sample No. | Dye providing compound | Fresh $D_{max}$ | Fresh $D_{min}$ | Aged $D_{max}$ | Aged $D_{min}$ | Remarks |
|---|---|---|---|---|---|---|
| 107 | M-2 | 0.17 | 1.36 | 0.23 | 1.10 | Comp. |
| 108 | 2-1 | 0.16 | 1.51 | 0.14 | 1.52 | Inv. |
| 109 | 2-8 | 0.16 | 1.53 | 0.16 | 1.51 | Inv. |
| 110 | 2-11 | 0.15 | 1.47 | 0.16 | 1.47 | Inv. |
| 111 | 3-2 | 0.16 | 1.50 | 0.15 | 1.51 | Inv. |
| 112 | 3-7 | 0.14 | 1.49 | 0.15 | 1.49 | Inv. |

M-2

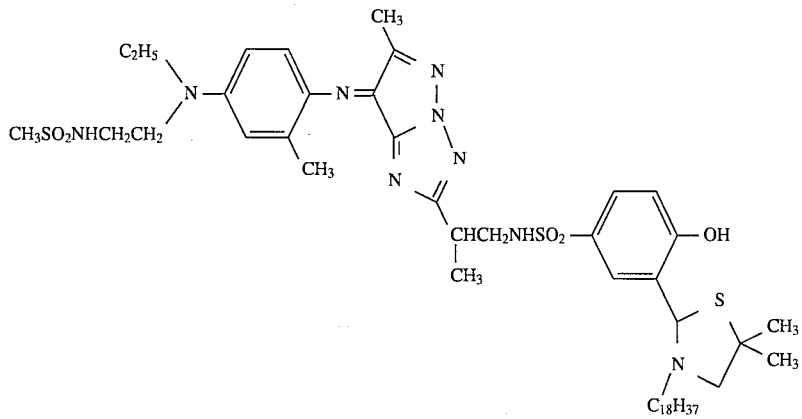

(A compound described in Japanese Patent Application No. 6-76045 (1994))

As can be seen from Table 1, according to a heat-developable photosensitive material containing a dye-providing compound of the invention, a magenta dye image with a sufficiently high maximum density and low fog minimum density) was obtained at a low temperature for a short period of time. Furthermore, it was proved that, even after being aged, an excellent magenta dye image with a low fog density was obtained. In addition, it was shown that a dye-providing compound of the invention was readily prepared according to a method known in the art.

What is claimed is:

1. A heat-developable photosensitive material for use in diffusion transfer process, comprising a support having in one or more layers a hydrophilic binder, photosensitive silver halide and dye-providing compound, wherein said dye-providing compound is represented by the following formula (I), $$[A\text{-}(J_1)_a\text{-}(X)_b]_c\text{-}J_2\text{-Dye} \qquad \text{Formula (I)}$$

wherein A represents a 1,3-sulfur-nitrogen compound residue capable of releasing $[\text{-}(J_1)_a\text{-}(X)_b]_c\text{-}J_2$-Dye residue upon cleavage in the presence of a silver ion or a soluble silver complex; $J_1$ represents a divalent linking group and $J_2$ represents a divalent or trivalent linking group; X represents a divalent linking group selected from —CO—, —COO—, —CONH—, —$SO_2$—, —$SO_2$NH—, —$SO_3$—, —NHCO—, —$NHSO_2$— and —O—; a and b independently represent 0 or 1; c represents 1 or 2; Dye represents a group represented by the following formula (II), (III) or (IV),

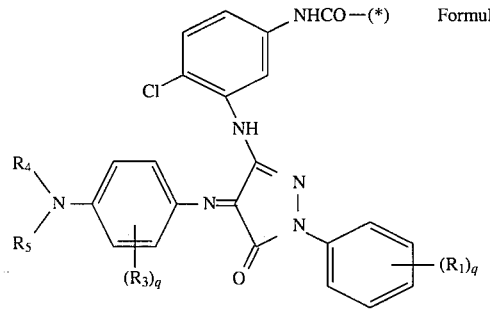

Formula (II)

wherein $R_1$ represents a halogen atom, alkyl group, alkoxy group, aryloxy group, acylamino group, sulfonylamino group, carbamoyl group or sulfamoyl group; $R_3$ represents an alkyl group, acylamino group or alkoxy group; $R_4$ and $R_5$ independently represent an alkyl group, cycloalkyl group or aryl group, and $R_4$ and $R_5$ may be combined with each other to form a ring; p is an integer of 0 to 5; q is an integer of 0 to 4; provided that Dye represented by the above formula (II) is bonded, at the position (*), with $[A\text{-}(J_1)_a\text{-}(X)_b]_c\text{-}J_2$- residue,

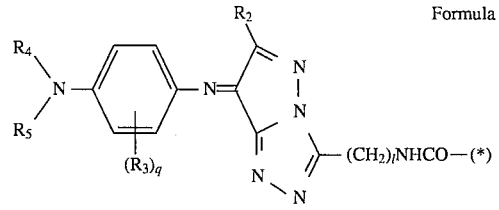

Formula (III)

wherein $R_2$ represents an alkyl group, cycloalkyl group, aryl group, heterocyclic group, alkoxy group, aryloxy group, acylamino group, sulfonylamino group or anilino group; $R_3$, $R_4$ and $R_5$ each are the same as $R_3$, $R_4$ and $R_5$ as defined in formula (II); q represents an integer of 0 to 4; l represents an integer of 1 to 3; provided that Dye represented by the above formula (III) is bonded, at the position (*), with $[A\text{-}(J_1)_a\text{-}(X)_b]_c\text{-}J_2\text{-}$ residue, Formula (IV)

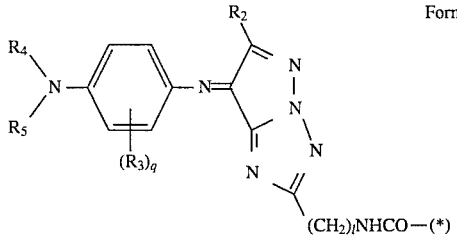

wherein $R_2$, $R_3$, $R_4$ and $R_5$ are the same as $R_2$, $R_3$, $R_4$ and $R_5$ defined in formula (III); q represents an integer of 0 to 4; l represents an integer of 1 to 3; provided that Dye represented by the above formula is bonded, at the position (*), with $[A\text{-}(J_1)_a\text{-}(X)_b]_c\text{-}J_2\text{-}$ residue.

2. The heat-developable photosensitive material of claim 1, wherein said A is a thiazolidinyl residue represented by the following formula (V)

Formula (V)

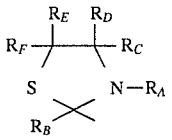

wherein $R_A$ represents a hydrogen atom, alkyl group, cycloalkyl group, aryl group, heterocyclic group, acyl group or sulfonyl group; $R_B$ represents a hydrogen atom, alkyl group, cycloalkyl group, aryl group, heterocyclic group or a group represented by $[\text{-}(J_1)_a\text{-}(X)_b]_c\text{-}J_2\text{-Dye}$; $R_C$, $R_D$, $R_E$ and $R_F$ independently represents a hydrogen atom, alkyl group, aryl group, heterocyclic group, carboxy group, acyl group, sulfonyl group or sulfo group.

3. The heat-developable photosensitive material of claim 2, wherein said dye-providing compound is represented by the following formula (VI) or (VII), Formula (VI)

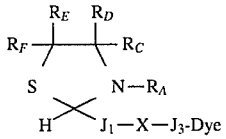

Formula (VII)

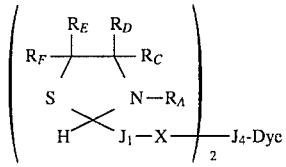

wherein $R_A$, $R_B$, $R_C$, $R_D$, $R_E$ and $R_F$ are the same as $R_A$, $R_B$, $R_C$, $R_D$, $R_E$ and $R_F$ defined in formula (V), respectively; $J_1$, X and Dye are the same as $J_1$, X and Dye defined in formula (I); $J_3$ represents a divalent linking group and $J_4$ represents a trivalent linking group.

4. The heat-developable photosensitive material of claim 3, wherein said dye-providing compound is represented by formula (VI).

5. The heat-developable photosensitive material of claim 1, wherein said dye-providing compound is contained in an amount of 0.05 to 10 g per $m^2$ of the photosensitive material.

6. The heat-developable photosensitive material of claim 1, wherein said photosensitive silver halide is silver chloride, silver bromide, silver iodobromide, silver chlorobromide or silver iodochlorobromide.

7. The heat-developable photosensitive material of claim 1, wherein said photosensitive material further contains a reducing agent.

* * * * *